US009494157B2

(12) United States Patent
Doepker

(10) Patent No.: US 9,494,157 B2
(45) **Date of Patent: *Nov. 15, 2016**

(54) COMPRESSOR WITH CAPACITY MODULATION AND VARIABLE VOLUME RATIO

(71) Applicant: Emerson Climate Technologies, Inc., Sidney, OH (US)

(72) Inventor: Roy J. Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/846,877

(22) Filed: Sep. 7, 2015

(65) Prior Publication Data

US 2016/0025093 A1 Jan. 28, 2016

Related U.S. Application Data

(63) Continuation of application No. 14/073,246, filed on Nov. 6, 2013, now Pat. No. 9,127,677.

(60) Provisional application No. 61/731,594, filed on Nov. 30, 2012.

(51) Int. Cl.
*F04C 28/16* (2006.01)
*F04C 28/24* (2006.01)
(Continued)

(52) U.S. Cl.
CPC ..... *F04C 28/16* (2013.01); *F04C 18/0215* (2013.01); *F04C 18/0261* (2013.01); *F04C 23/008* (2013.01); *F04C 28/24* (2013.01)

(58) Field of Classification Search
CPC . F04C 18/0261; F04C 28/16; F04C 18/0215
See application file for complete search history.

(56) References Cited

U.S. PATENT DOCUMENTS 4,058,988 A 11/1977 Shaw
4,216,661 A 8/1980 Tojo et al.
(Continued)

FOREIGN PATENT DOCUMENTS

CN 1158944 A 9/1997
CN 1158945 A 9/1997
(Continued)

OTHER PUBLICATIONS

Advisory Action regarding U.S. Appl. No. 14/073,293, dated Apr. 18, 2016.
(Continued)

*Primary Examiner* — Mary A Davis
(74) *Attorney, Agent, or Firm* — Harness, Dickey & Pierce, P.L.C.

(57) ABSTRACT

A compressor is provided and may include a shell assembly defining a suction pressure region and a discharge pressure region. A first scroll member may include a first discharge port and a first modulation port. A second scroll member may include a first variable volume ratio port. A capacity modulation valve assembly may be in fluid communication with the first modulation port and may be displaceable between open and closed positions to selectively provide communication between a first intermediate compression pocket and the suction pressure region via the first modulation port. A variable volume ratio valve assembly may be in fluid communication with the first variable volume ratio port. The variable volume ratio valve assembly may be displaceable between open and closed positions to selectively provide communication between a second intermediate compression pocket and the discharge pressure region via the first variable volume ratio port.

21 Claims, 4 Drawing Sheets

(51) Int. Cl.
*F04C 18/02* (2006.01)
*F04C 23/00* (2006.01)

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,475,360 A 10/1984 Suefuji et al.
4,497,615 A 2/1985 Griffith
4,545,742 A 10/1985 Schaefer
4,609,329 A 9/1986 Pillis et al.
4,696,630 A 9/1987 Sakata et al.
4,727,725 A 3/1988 Nagata et al.
4,774,816 A 10/1988 Uchikawa et al.
4,818,195 A 4/1989 Murayama et al.
4,846,633 A 7/1989 Suzuki et al.
4,877,382 A 10/1989 Caillat et al.
4,886,425 A 12/1989 Itahana et al.
4,940,395 A 7/1990 Yamamoto et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
RE34,148 E 12/1992 Terauchi et al.
5,169,294 A 12/1992 Barito
5,192,195 A 3/1993 Iio et al.
5,193,987 A 3/1993 Iio et al.
5,240,389 A 8/1993 Oikawa et al.
5,253,489 A 10/1993 Yoshii
5,356,271 A 10/1994 Miura et al.
5,451,146 A 9/1995 Inagaki et al.
5,482,637 A 1/1996 Rao et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,607,288 A 3/1997 Wallis et al.
5,613,841 A 3/1997 Bass et al.
5,639,225 A 6/1997 Matsuda et al.
5,640,854 A 6/1997 Fogt et al.
5,674,058 A 10/1997 Matsuda et al.
5,678,985 A 10/1997 Brooke et al.
5,722,257 A 3/1998 Ishii et al.
5,741,120 A 4/1998 Bass et al.
5,855,475 A 1/1999 Fujio et al.
5,885,063 A 3/1999 Makino et al.
5,993,171 A 11/1999 Higashiyama
5,993,177 A 11/1999 Terauchi et al.
6,047,557 A 4/2000 Pham et al.
6,086,335 A 7/2000 Bass et al.
6,095,765 A 8/2000 Khalifa
6,102,671 A 8/2000 Yamamoto et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,164,940 A 12/2000 Terauchi et al.
6,176,686 B1 1/2001 Wallis et al.
6,179,589 B1 1/2001 Bass et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,273,691 B1 8/2001 Morimoto et al.
6,293,767 B1 9/2001 Bass
6,293,776 B1 9/2001 Hahn et al.
6,322,340 B1 11/2001 Itoh et al.
6,350,111 B1 2/2002 Perevozchikov et al.
6,379,123 B1 4/2002 Makino et al.
6,412,293 B1 7/2002 Pham et al.
6,413,058 B1 7/2002 Williams et al.
6,419,457 B1 7/2002 Seibel et al.
6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.
6,506,036 B2 1/2003 Tsubai et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,679,683 B2 1/2004 Seibel et al.
6,715,999 B2 4/2004 Ancel et al.
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,893,229 B2 5/2005 Choi et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,207,787 B2 4/2007 Liang et al.
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,547,202 B2 6/2009 Knapke
7,717,687 B2 5/2010 Reinhart
7,771,178 B2 8/2010 Perevozchikov et al.
7,802,972 B2 9/2010 Shimizu et al.
7,891,961 B2 2/2011 Shimizu et al.
RE42,371 E 5/2011 Peyton
7,967,582 B2 6/2011 Akei et al.
7,967,583 B2 6/2011 Stover et al.
7,972,125 B2 7/2011 Stover et al.
7,976,295 B2 7/2011 Stover et al.
7,988,433 B2 8/2011 Akei et al.
8,025,492 B2 9/2011 Seibel et al.
8,506,271 B2 8/2013 Seibel et al.
8,517,703 B2 8/2013 Doepker
8,585,382 B2 11/2013 Akei et al.
8,616,014 B2 12/2013 Stover et al.
8,857,200 B2 10/2014 Stover et al.
9,127,677 B2 * 9/2015 Doepker ..... F04C 18/0261
9,249,802 B2 2/2016 Doepker et al.
2001/0010800 A1 8/2001 Kohsokabe et al.
2002/0039540 A1 4/2002 Kuroki et al.
2003/0044296 A1 3/2003 Chen
2003/0186060 A1 10/2003 Rao
2004/0136854 A1 7/2004 Kimura et al.
2004/0146419 A1 7/2004 Kawaguchi et al.
2004/0184932 A1 9/2004 Lifson
2004/0197204 A1 10/2004 Yamanouchi et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton
2005/0201883 A1 9/2005 Clendenin et al.
2005/0214148 A1 9/2005 Ogawa et al.
2006/0099098 A1 5/2006 Lee et al.

(56) References Cited

U.S. PATENT DOCUMENTS

| | | | |
|---|---|---|---|
| 2006/0228243 | A1 | 10/2006 | Sun et al. |
| 2006/0233657 | A1 | 10/2006 | Bonear et al. |
| 2007/0036661 | A1 | 2/2007 | Stover |
| 2007/0110604 | A1 | 5/2007 | Peyton |
| 2007/0130973 | A1 | 6/2007 | Lifson et al. |
| 2008/0159892 | A1 | 7/2008 | Huang et al. |
| 2008/0196445 | A1 | 8/2008 | Lifson et al. |
| 2008/0223057 | A1 | 9/2008 | Lifson et al. |
| 2008/0305270 | A1 | 12/2008 | Uhlianuk et al. |
| 2009/0068048 | A1 | 3/2009 | Stover et al. |
| 2009/0071183 | A1 | 3/2009 | Stover et al. |
| 2009/0185935 | A1 | 7/2009 | Seibel et al. |
| 2009/0297377 | A1 | 12/2009 | Stover et al. |
| 2009/0297378 | A1 | 12/2009 | Stover et al. |
| 2009/0297379 | A1 | 12/2009 | Stover et al. |
| 2009/0297380 | A1 | 12/2009 | Stover et al. |
| 2010/0111741 | A1 | 5/2010 | Chikano et al. |
| 2010/0135836 | A1 | 6/2010 | Stover et al. |
| 2010/0158731 | A1 | 6/2010 | Akei et al. |
| 2010/0212311 | A1 | 8/2010 | McQuary et al. |
| 2010/0254841 | A1 | 10/2010 | Akei et al. |
| 2010/0300659 | A1 | 12/2010 | Stover et al. |
| 2010/0303659 | A1 | 12/2010 | Stover et al. |
| 2011/0135509 | A1 | 6/2011 | Fields et al. |
| 2011/0206548 | A1 | 8/2011 | Doepker |
| 2011/0293456 | A1 | 12/2011 | Seibel et al. |
| 2012/0107163 | A1 | 5/2012 | Monnier et al. |
| 2013/0078128 | A1 | 3/2013 | Akei |
| 2013/0121857 | A1 | 5/2013 | Liang et al. |
| 2013/0309118 | A1 | 11/2013 | Ginies et al. |
| 2013/0315768 | A1 | 11/2013 | Le Coat et al. |
| 2014/0023540 | A1 | 1/2014 | Heidecker et al. |
| 2014/0024563 | A1 | 1/2014 | Heidecker et al. |
| 2014/0037486 | A1 | 2/2014 | Stover et al. |
| 2014/0134030 | A1 | 5/2014 | Stover et al. |
| 2014/0134031 | A1 | 5/2014 | Doepker et al. |
| 2014/0147294 | A1 | 5/2014 | Fargo et al. |
| 2014/0154121 | A1 | 6/2014 | Doepker |
| 2014/0154124 | A1 | 6/2014 | Doepker et al. |

FOREIGN PATENT DOCUMENTS

| | | | |
|---|---|---|---|
| CN | 1289011 | A | 3/2001 |
| CN | 1382912 | A | 12/2002 |
| CN | 1517553 | A | 8/2004 |
| CN | 1680720 | A | 10/2005 |
| CN | 1702328 | A | 11/2005 |
| CN | 1963214 | A | 5/2007 |
| CN | 1995756 | A | 7/2007 |
| CN | 101761479 | A | 6/2010 |
| CN | 101806302 | A | 8/2010 |
| CN | 101910637 | A | 12/2010 |
| CN | 102076963 | A | 5/2011 |
| CN | 102449314 | A | 5/2012 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| JP | 60259794 | | 12/1985 |
| JP | 63-205482 | | 8/1988 |
| JP | 03081588 | A | 4/1991 |
| JP | H07-293456 | A | 11/1995 |
| JP | 08334094 | A | 12/1996 |
| JP | H09-177689 | A | 7/1997 |
| JP | 11107950 | | 4/1999 |
| JP | 2000104684 | A | 4/2000 |
| JP | 2000161263 | A | 6/2000 |
| JP | 2000329078 | A | 11/2000 |
| JP | 2003074481 | A | 3/2003 |
| JP | 2003074482 | A | 3/2003 |
| JP | 2003106258 | A | 4/2003 |
| JP | 2003227479 | A | 8/2003 |
| JP | 2007154761 | A | 6/2007 |
| JP | 2008248775 | A | 10/2008 |
| KR | 1019870000015 | | 5/1985 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101192642 | B1 | 10/2012 |
| WO | WO-0073659 | A1 | 12/2000 |
| WO | 2007046810 | A2 | 4/2007 |
| WO | WO-2009155099 | A2 | 12/2009 |
| WO | WO-2010118140 | A2 | 10/2010 |

OTHER PUBLICATIONS

First Office Action regarding Chinese Application No. 201380059666.8, dated Apr. 5, 2016. Translation provided by Unitalen Attorneys at Law.

First Office Action regarding Chinese Application No. 201380062614.6, dated Apr. 5, 2016. Translation provided by Unitalen Attorneys at Law.

Office Action regarding Chinese Patent Application No. 201380059963.2, dated May 10, 2016. Translation provided by Unitalen Attorneys at Law.

Office Action regarding Chinese Patent Application No. 201380062657.4, dated May 4, 2016. Translation provided by Unitalen Attorneys at Law.

Office Action regarding Chinese Patent Application No. 201410460792.0, dated Feb. 25, 2016. Translation provided by Unitalen Attorneys at Law.

Office Action regarding Chinese Patent Application No. 201410461048.2, dated Nov. 30, 2015. Translation provided by Unitalen Attorneys at Law.

Office Action regarding U.S. Appl. No. 14/073,293, dated Jan. 29, 2016.

Restriction Requirement regarding U.S. Appl. No. 14/060,102, dated Mar. 16, 2016.

International Search Report regarding Application No. PCT/US2011/025921, mailed Oct. 7, 2011.

Written Opinion of the International Search Authority regarding Application No. PCT/US2011/025921, mailed Oct. 7, 2011.

Written Opinion of the International Searching Authority regarding Application No. PCT/US2010/030248, mailed Nov. 26, 2010.

International Search Report regarding Application No. PCT/US2010/030248, mailed Nov. 26, 2010.

U.S. Office Action regarding U.S. Appl. No. 13/181,065 mailed Nov. 9, 2012.

International Search Report regarding Application No. PCT/US2013/051678, mailed Oct. 21, 2013.

Written Opinion of the International Searching Authority regarding Application No. PCT/US2013/051678, mailed Oct. 21, 2013.

U.S. Office Action regarding U.S. Appl. No. 11/645,288 mailed Nov. 30, 2009.

Extended European Search Report regarding Application No. EP07254962 dated Mar. 12, 2008.

First China Office Action regarding Application No. 200710160038.5 dated Jul. 8, 2010. Translation provided by Unitalen Attorneys at Law.

China Office Action regarding Application No. 200710160038.5 dated Jan. 31, 2012. Translation provided by Unitalen Attorneys at Law.

China Office Action regarding Application No. 201080020243.1 dated Nov. 5, 2013. Translation provided by Unitalen Attorneys at Law.

International Search Report regarding Application No. PCT/US2013/069462, mailed Feb. 21, 2014.

Written Opinion of the Internation Searching Authority regarding Application No. PCT/US2013/069462, mailed Feb. 21, 2014.

International Search Report regarding Application No. PCT/US2013/070981, mailed Mar. 4, 2014.

Written Opinion of the International Searching Authority regarding Application No. PCT/US2013/070981, mailed Mar. 4, 2014.

(56) References Cited

OTHER PUBLICATIONS

International Search Report regarding Application No. PCT/US2013/069456, mailed Feb. 18, 2014.
Written Opinion of the International Searching Authority regarding Application No. PCT/US2013/069456, mailed Feb. 18, 2014.
International Search Report regarding Application No. PCT/US2013/070992, mailed Feb. 25, 2014.
Written Opinion of the International Searching Authority regarding Application No. PCT/US2013/070992, mailed Feb. 25, 2014.
Second Office Action regarding China Application No. 201180010366.1 dated Dec. 31, 2014. Translation provided by Unitalen Attorneys at Law.
Office Action regarding U.S. Appl. No. 14/081,390, mailed Mar. 27, 2015.
Search Report regarding European Patent Application No. 10762374.6-1608 / 2417356 PCT/US2010030248, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
Office Action regarding U.S. Appl. No. 14/294,458, dated Aug. 19, 2016.
Office Action regarding U.S. Appl. No. 14/060,102, dated Jun. 14, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.

* cited by examiner

COMPRESSOR WITH CAPACITY MODULATION AND VARIABLE VOLUME RATIO

CROSS-REFERENCE TO RELATED APPLICATIONS

This application claims the benefit of U.S. patent application Ser. No. 14/073,246, filed Nov. 6, 2013, which claims the benefit of U.S. Provisional Application No. 61/731,594, filed on Nov. 30, 2012. The entire disclosure of the above application is incorporated herein by reference.

FIELD

The present disclosure relates to compressors, as well as capacity modulation and variable volume ratio of compressors.

BACKGROUND

This section provides background information related to the present disclosure which is not necessarily prior art.

Conventional scroll compressors may include one or more of a variety of output adjustment assemblies to vary the operating capacity of the compressor. The output adjustment assemblies may include fluid passages extending through a scroll member to selectively provide fluid communication between compression pockets and another pressure region of the compressor.

SUMMARY

This section provides a general summary of the disclosure, and is not comprehensive of its full scope or all of its features.

A compressor is provided and may include a shell assembly defining a suction pressure region and a discharge pressure region. A first scroll member may be disposed within the shell assembly and may include a first spiral wrap extending from a first side thereof and a first end plate defining a first discharge port and a first modulation port. A second scroll member may be disposed within the shell assembly and may include a second spiral wrap extending therefrom and a second end plate defining a first variable volume ratio port. The second spiral wrap may be meshingly engaged with the first spiral wrap to form a suction pocket in fluid communication with the suction pressure region, intermediate compression pockets, and a discharge pocket in fluid communication with the discharge pressure region. A first one of the intermediate compression pockets may be in fluid communication with the first modulation port and a second one of the intermediate compression pockets may be in fluid communication with the first variable volume ratio port.

A capacity modulation valve assembly may be located within the shell assembly and may be in fluid communication with the first modulation port and may be displaceable between open and closed positions to selectively provide communication between the first intermediate compression pocket and the suction pressure region via the first modulation port. A variable volume ratio valve assembly may be located within the shell assembly and may be in fluid communication with the first variable volume ratio port. The variable volume ratio valve assembly may be displaceable between open and closed positions to selectively provide communication between the second intermediate compression pocket and the discharge pressure region via the first variable volume ratio port.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
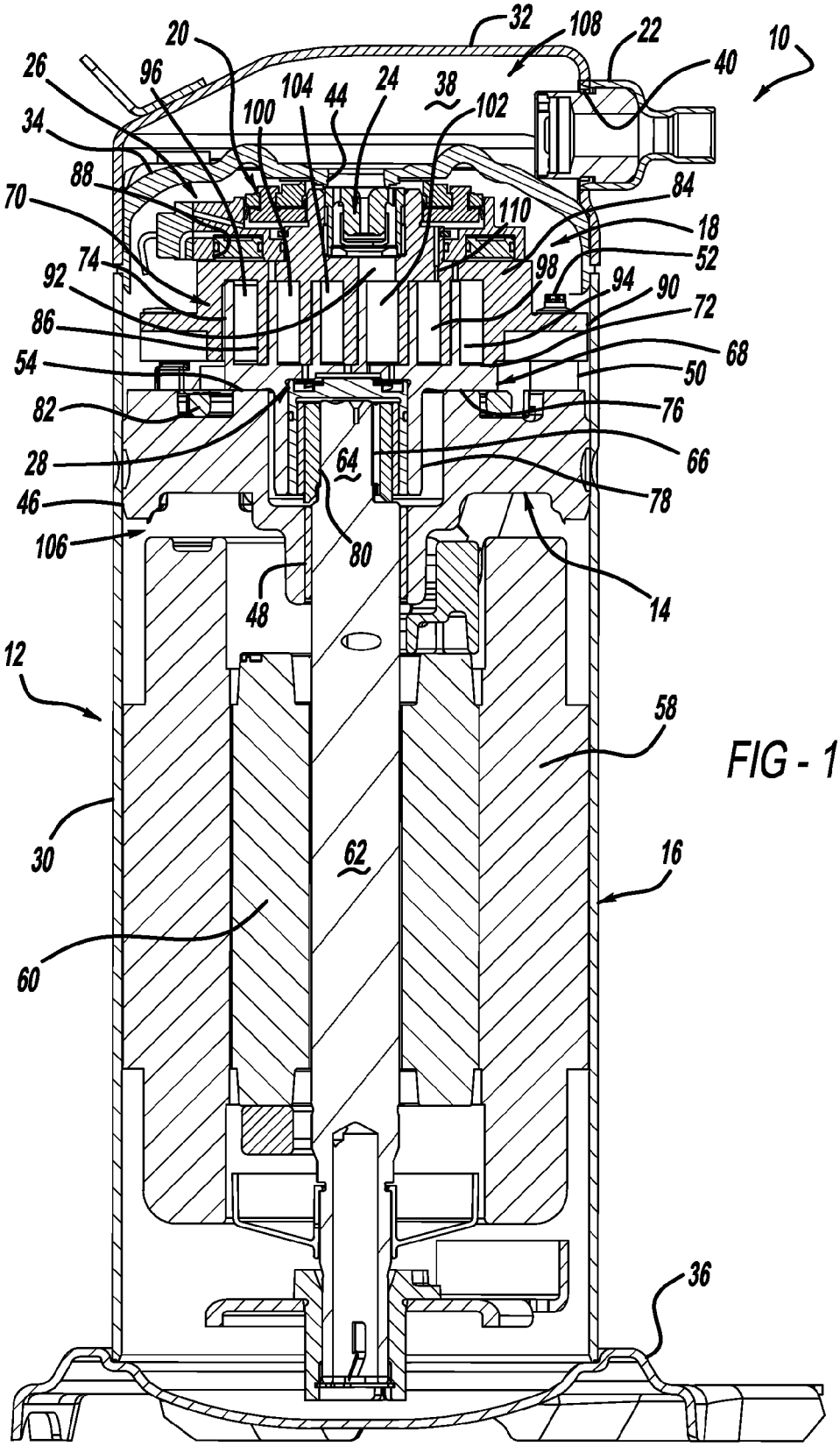
FIG. 1 is a section view of a compressor according to the present disclosure.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a hermetic shell assembly 12, a bearing housing assembly 14, a motor assembly 16, a compression mechanism 18, a seal assembly 20, a refrigerant discharge fitting 22, a discharge valve assembly 24, a suction gas inlet fitting (not shown), a capacity modulation valve assembly 26 and a variable volume ratio (WR) valve assembly 28. Shell assembly 12 may house bearing housing assembly 14, motor assembly 16, compression mechanism 18, and WR valve assembly 28.

Shell assembly 12 may generally form a compressor housing and may include a cylindrical shell 30, an end cap 32 at the upper end thereof, a transversely extending partition 34, and a base 36 at a lower end thereof. End cap 32 and partition 34 may generally define a discharge chamber 38. Discharge chamber 38 may generally form a discharge muffler for compressor 10. While illustrated as including discharge chamber 38, it is understood that the present disclosure applies equally to direct discharge configurations.

Refrigerant discharge fitting 22 may be attached to shell assembly 12 at opening 40 in end cap 32 and may define a first discharge passage. The suction gas inlet fitting (not shown) may be attached to shell assembly 12 at an opening (not shown). Partition 34 may define a second discharge passage 44 therethrough providing communication between compression mechanism 18 and discharge chamber 38.

Bearing housing assembly 14 may be affixed to shell 30 at a plurality of points in any desirable manner, such as staking. Bearing housing assembly 14 may include a main bearing housing 46, a bearing 48 disposed therein, bushings 50, and fasteners 52. Main bearing housing 46 may house bearing 48 therein and may define an annular flat thrust bearing surface 54 on an axial end surface thereof.

Motor assembly 16 may generally include a motor stator 58, a rotor 60, and a drive shaft 62. Motor stator 58 may be press fit into shell 30. Drive shaft 62 may be rotatably driven by rotor 60 and may be rotatably supported within bearing 48. Rotor 60 may be press fit on drive shaft 62. Drive shaft 62 may include an eccentric crank pin 64 having a flat 66 thereon.

Compression mechanism 18 may generally include an orbiting scroll 68 and a non-orbiting scroll 70. Orbiting scroll 68 may include an end plate 72 having a spiral vane or wrap 74 on the upper surface thereof and an annular flat thrust surface 76 on the lower surface. Thrust surface 76 may interface with annular flat thrust bearing surface 54 on main bearing housing 46. A cylindrical hub 78 may project downwardly from thrust surface 76 and may have a drive bushing 80 rotatably disposed therein. Drive bushing 80 may include an inner bore in which crank pin 64 is drivingly disposed. Crank pin flat 66 may drivingly engage a flat surface in a portion of the inner bore of drive bushing 80 to provide a radially compliant driving arrangement. An Oldham coupling 82 may be engaged with the orbiting and non-orbiting scrolls 68, 70 to prevent relative rotation therebetween.

Non-orbiting scroll 70 may include an end plate 84 defining a first discharge port 92 and having a spiral wrap 86 extending from a first side thereof, an annular recess 88 extending into a second side thereof opposite the first side, and a series of radially outwardly extending flanged portions 90 (FIG. 1) engaged with fasteners 52. Fasteners 52 may rotationally fix non-orbiting scroll 70 relative to main bearing housing 46 while allowing axial displacement of non-orbiting scroll 70 relative to main bearing housing 46. Discharge valve assembly 24 may be coupled to the end plate 84 of the non-orbiting scroll 70 and may generally prevent a reverse flow condition. Spiral wraps 74, 86 may be meshingly engaged with one another defining pockets 94, 96, 98, 100, 102, 104. It is understood that pockets 94, 96, 98, 100, 102, 104 change throughout compressor operation.

A first pocket, pocket 94 in FIG. 1, may define a suction pocket in communication with a suction pressure region 106 of compressor 10 operating at a suction pressure ($P_s$) and a second pocket, pocket 104 in FIG. 1, may define a discharge pocket in communication with a discharge pressure region 108 of compressor 10 operating at a discharge pressure ($P_d$) via the first discharge port 92. Pockets intermediate the first and second pockets, pockets 96, 98, 100, 102 in FIG. 1, may form intermediate compression pockets operating at intermediate pressures between the suction pressure ($P_s$) and the discharge pressure ($P_d$). End plate 84 may additionally include a biasing passage 110 in fluid communication with one of the intermediate compression pockets.

Figure 2:
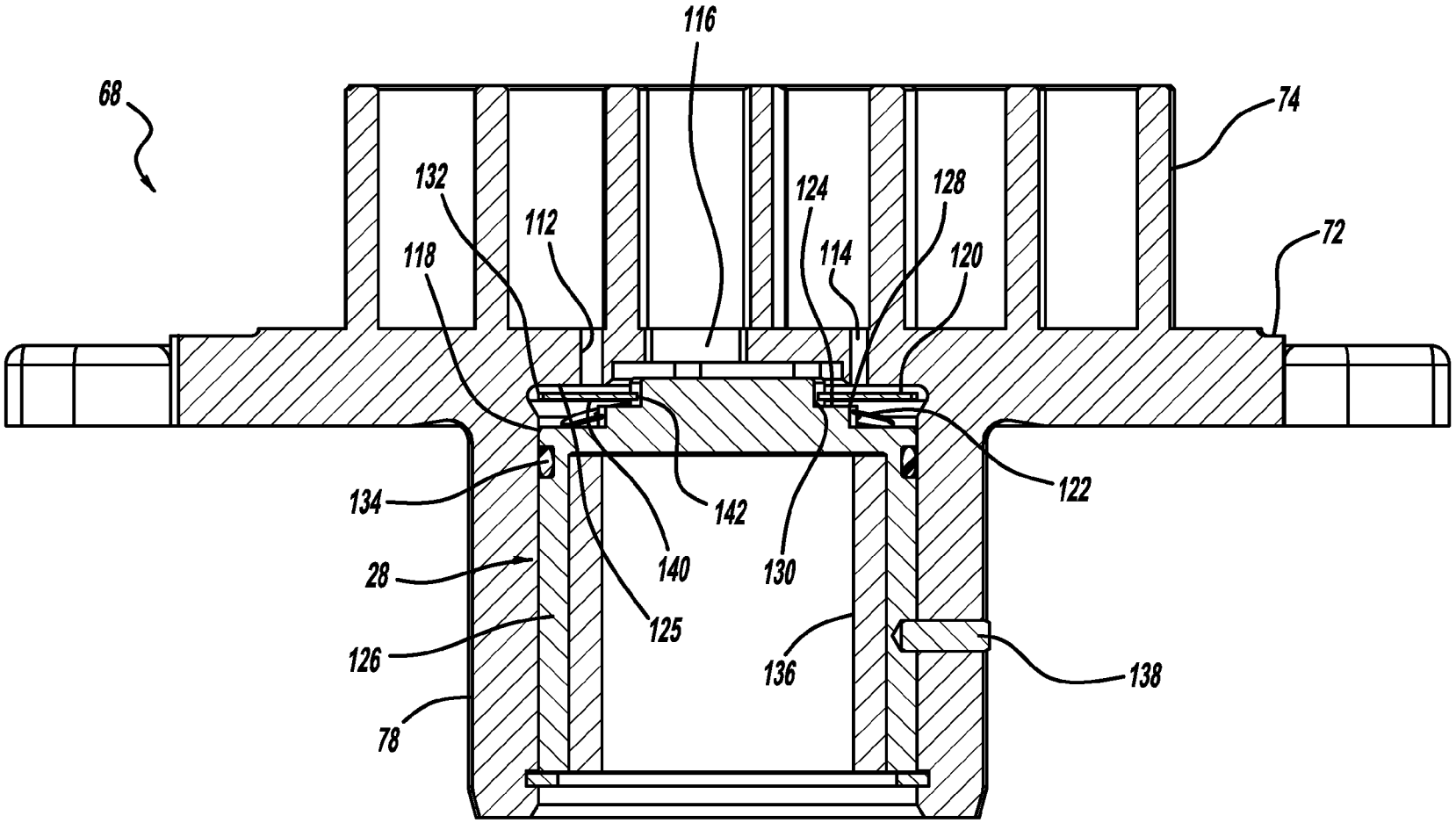
FIG. 2 is a section view of the orbiting scroll member and the variable volume ratio valve assembly of FIG. 1.

With additional reference to FIG. 2, the end plate 72 of orbiting scroll 68 may include first and second VVR ports 112, 114 and a second discharge port 116. The first and second discharge ports 92, 116 may each be in communication with the discharge pocket. The first VVR ports 112 may be in communication with a first intermediate compression pocket and the second WR ports 114 may be in communication with a second intermediate compression pocket. The first and second WR ports 112, 114 may be located radially outward relative to the first and second discharge ports 92, 116. The biasing passage 110 may be in fluid communication with one of the intermediate compression pockets located radially outward from and operating at a lower pressure relative to the intermediate compression pockets in fluid communication with first and second VVR ports 112, 114.

WR valve assembly 28 may include a valve housing 118, a VVR valve 120 and a biasing member 122. The valve housing 118 may define a valve stop region 124 and an annular wall 126 located within the hub 78 of the orbiting scroll 68 and extending axially from a valve stop region 124. The valve stop region 124 may be located axially between the drive shaft 62 and the end plate 72. An annular recess 128 may be defined in an axial end of the valve stop region 124 facing the orbiting scroll 68 and may form an inner valve guide 130. The hub 78 of the orbiting scroll 68 may form an outer valve guide 132. The axial end surface of the end plate 72 of the orbiting scroll 68 defining the first and second VVR ports 112, 114 may form a valve seat 125 for the VVR valve 120.

A seal 134 may surround the annular wall 126 and may be engaged with the annular wall 126 and the hub 78 to isolate the suction pressure region of the compressor from the first and second WR ports 112, 114 and the second discharge port 116. A drive bearing 136 may be located within the annular wall 126 of the valve housing 118 and may surround the drive bushing 80 and drive shaft 62. A pin 138 may be engaged with the valve housing 118 and the hub 78 of the orbiting scroll 68 to inhibit relative rotation between the valve housing 118 and the orbiting scroll 68.

The VVR valve 120 may be located axially between the valve stop region 124 of the valve housing 118 and the valve seat 125 of end plate 72 of the orbiting scroll 68. The VVR valve 120 may include an annular body 140 radially aligned with the first and second VVR ports 112, 114, surrounding the second discharge port 116 and defining a central aperture 142 radially aligned with the second discharge port 116. The inner valve guide 130 may extend through the central aperture 142 and the outer valve guide 132 may surround an outer perimeter of the annular body 140 to guide axial displacement of the VVR valve 120 between open and closed positions. The biasing member 122 may urge the WR valve 120 to the closed position and the WR valve 120 may be displaced to the open position by pressurized fluid within the intermediate compression pockets via the first and second VVR ports 112, 114.

The WR valve 120 may overlie the first and second WR ports 112, 114 and sealingly engage valve seat 125 to isolate the first and second WR ports 112, 114 from communication with the second discharge port 116 when in the closed position. The VVR valve 120 may be axially offset from the valve seat 125 to provide communication between the first and second VVR ports 112, 114 and the second discharge port 116 when in the open position. The first and second intermediate compression pockets may be placed in communication with the discharge pocket when the VVR valve 120 is in the open position.

More specifically, a flow path may be defined from the first and second intermediate compression pockets to the first discharge port 92 when the VVR valve 120 is in the open position. The flow path may be defined through the first and second VVR ports 112, 114 to a space between the valve housing 118 and the end plate 72 of the orbiting scroll 68 to the second discharge port 116 to the first discharge port 92.

Figure 3:
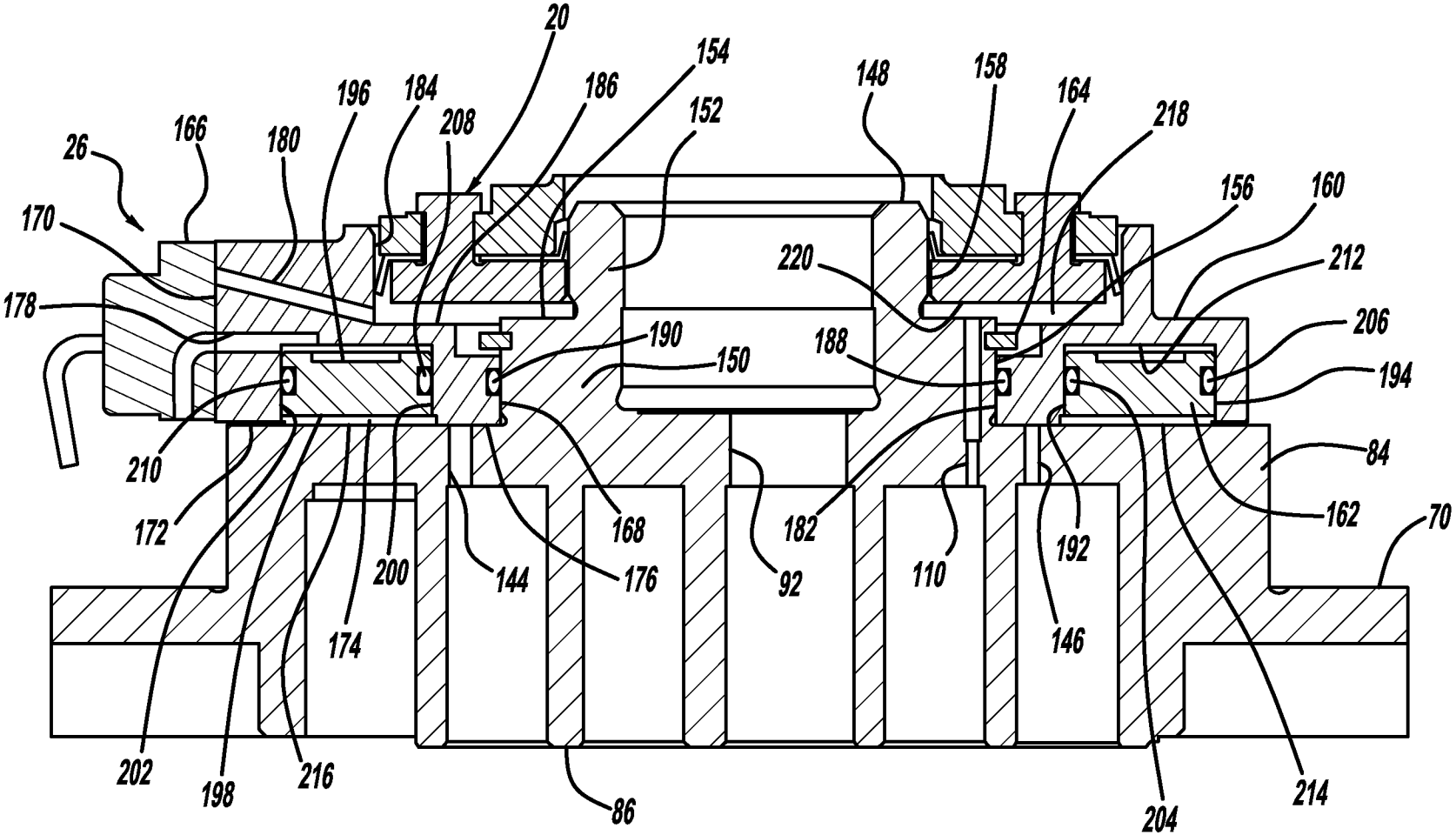
FIG. 3 is a section view of the non-orbiting scroll member and the capacity modulation valve assembly of FIG. 1 with the capacity modulation valve assembly in a closed position.
Figure 4:
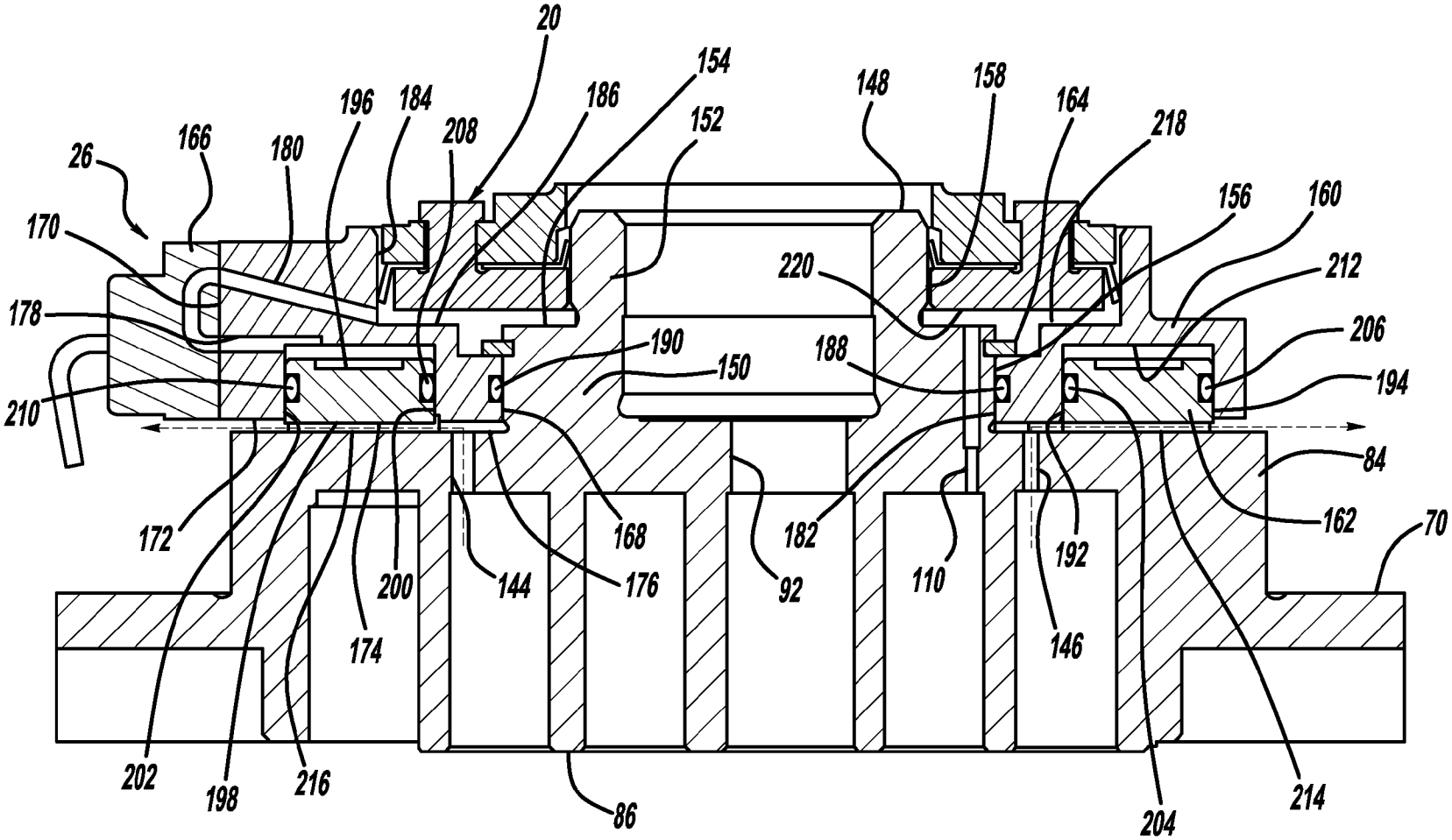
FIG. 4 is a section view of the non-orbiting scroll member and the capacity modulation valve assembly of FIG. 1 with the capacity modulation valve assembly in an open position.

With additional reference to FIGS. 3 and 4, the end plate 84 of the non-orbiting scroll 70 may additionally include first and second modulation ports 144, 146. The first and second modulation ports 144, 146 may each be in fluid communication with one of the intermediate compression pockets. The biasing passage 110 may be in fluid communication with one of the intermediate compression pockets operating at a higher pressure than ones of intermediate compression pockets in fluid communication with first and second modulation ports 144, 146.

The non-orbiting scroll member 70 may include an annular hub 148 having first and second portions 150, 152 axially spaced from one another forming a stepped region 154 therebetween. First portion 150 may be located axially between second portion 152 and end plate 84 and may have an outer radial surface 156 defining a first diameter ($D_1$) greater than or equal to a second diameter ($D_2$) defined by an outer radial surface 158 of second portion 152.

Capacity modulation valve assembly 26 may include a modulation valve ring 160, a modulation lift ring 162, a retaining ring 164, and a modulation control valve assembly 166. Modulation valve ring 160 may include an inner radial surface 168, an outer radial surface 170, a first axial end surface 172 defining an annular recess 174 and a valve portion 176, and first and second passages 178, 180. Inner radial surface 168 may include first and second portions 182, 184 defining a second axial end surface 186 therebetween. First portion 182 may define a third diameter ($D_3$) less than a fourth diameter ($D_4$) defined by the second portion 184. The first and third diameters ($D_1$, $D_3$) may be approximately equal to one another and the first portions 150, 182 may be sealingly engaged with one another via a seal 188 located radially therebetween. More specifically, seal 188 may include an o-ring seal and may be located within an annular recess 190 in first portion 182 of modulation valve ring 160. Alternatively, the o-ring seal could be located in an annular recess in annular hub 148.

Modulation lift ring 162 may be located within annular recess 174 and may include an annular body defining inner and outer radial surfaces 192, 194, and first and second axial end surfaces 196, 198. Inner and outer radial surfaces 192, 194 may be sealingly engaged with sidewalls 200, 202 of annular recess 174 via first and second seals 204, 206. More specifically, first and second seals 204, 206 may include o-ring seals and may be located within annular recesses 208, 210 in inner and outer radial surfaces 192, 194 of modulation lift ring 162. Modulation valve ring 160 and modulation lift ring 162 may cooperate to define a modulation control chamber 212 between annular recess 174 and first axial end surface 196. First passage 178 may be in fluid communication with modulation control chamber 212. Second axial end surface 198 may face end plate 84 and may include a series of protrusions 214 defining radial flow passages 216 therebetween.

Seal assembly 20 may form a floating seal assembly and may be sealingly engaged with non-orbiting scroll 70 and modulation valve ring 160 to define an axial biasing chamber 218. More specifically, seal assembly 20 may be sealingly engaged with outer radial surface 158 of annular hub 148 and second portion 184 of modulation valve ring 160. Axial biasing chamber 218 may be defined axially between an axial end surface 220 of seal assembly 20 and second axial end surface 186 of modulation valve ring 160 and stepped region 154 of annular hub 148. Second passage 180 may be in fluid communication with axial biasing chamber 218.

Retaining ring 164 may be axially fixed relative to non-orbiting scroll 70 and may be located within axial biasing chamber 218. More specifically, retaining ring 164 may be located within a recess in first portion 150 of annular hub 148 axially between seal assembly 20 and modulation valve ring 160. Retaining ring 164 may form an axial stop for modulation valve ring 160. Modulation control valve assembly 166 may include a solenoid operated valve and may be in fluid communication with first and second passages 178, 180 in modulation valve ring 160 and suction pressure region 106.

During compressor operation, modulation control valve assembly 166 may be operated in first and second modes. In the first mode (FIG. 3), modulation control valve assembly 166 may provide fluid communication between modulation control chamber 212 and suction pressure region 106 to operate the compressor at full capacity. More specifically, modulation control valve assembly 166 may provide fluid communication between first passage 178 and suction pressure region 106 during operation in the first mode. In the second mode (FIG. 4), modulation control valve assembly 166 may provide fluid communication between modulation control chamber 212 and axial biasing chamber 218 to operate the compressor 10 at a partial capacity. More specifically, modulation control valve assembly 166 may provide fluid communication between first and second passages 178, 180 during operation in the second mode.

The pressure provided by the axial biasing chamber 218 may urge the modulation valve ring 160 upward and provide communication between the first and second modulation ports 144, 146 and the suction pressure region 106. The partial capacity may be approximately fifty percent of the full capacity. The compressor 10 may be operated at a capacity between the partial capacity and the full capacity through pulse width modulation of the capacity modulation valve assembly 26 between the first and second modes.

What is claimed is:

1. A compressor comprising:

a shell assembly;

a first scroll member disposed within said shell assembly, said first scroll member including a first end plate defining a discharge port and a first port and having a first spiral wrap extending from a first side thereof;

a second scroll member disposed within said shell assembly and including a second end plate defining a second port and having a second spiral wrap extending therefrom and meshingly engaged with said first spiral wrap to form a suction-pressure pocket in fluid communication with a suction-pressure region disposed outside of said first and second spiral wraps, intermediate-pressure pockets, and a discharge-pressure pocket in fluid communication with a discharge-pressure region disposed outside of said first and second spiral wraps, a first of said intermediate-pressure pockets being in fluid communication with said first port and a second of said intermediate-pressure pockets being in fluid communication with said second port;

a motor assembly driving relative orbital motion between said first and second scroll members;

a first valve assembly located within said shell assembly and in fluid communication with said first port, said first valve assembly displaceable between open and closed positions to selectively provide communication between said first intermediate-pressure pocket and said suction-pressure region via said first port; and a second valve assembly located within said shell assembly and in fluid communication with said second port, said second valve assembly displaceable between open and closed positions to selectively provide communication between said second intermediate-pressure pocket and said discharge-pressure region via said second port.

2. The compressor of claim 1, wherein said first scroll member is a non-orbiting scroll member, and said second scroll member is an orbiting scroll member.

3. The compressor of claim 1, further comprising a floating seal assembly engaging said first scroll member, and wherein said first scroll member is axially displaceable relative to said second scroll member, said floating seal assembly defining a biasing chamber that biases the first scroll member axially toward the second scroll member.

4. The compressor of claim 1, wherein the compressor operates at a full capacity when said first port is closed by said first valve assembly and operates at a reduced capacity relative to the full capacity when said first port is opened by said first valve assembly, said first valve assembly being adapted to cycle between opening and closing of said first port in a pulse width modulated manner to provide a compressor operating capacity between the reduced capacity and the full capacity.

5. The compressor of claim 1, wherein said first valve assembly includes:

a modulation valve ring located axially between a seal assembly and said first end plate and being in sealing engagement with an outer radial surface of an annular hub and said seal assembly to define an axial biasing chamber in fluid communication with a biasing passage in the first end plate, said modulation valve ring being axially displaceable between first and second positions, said modulation valve ring abutting said first end plate and closing said first port when in the first position and being displaced axially relative to said first end plate and opening said first port when in the second position;

a modulation lift ring located axially between said modulation valve ring and said first end plate and being in sealing engagement with said modulation valve ring to define a modulation control chamber; and a modulation control valve assembly operable in first and second modes and in fluid communication with said modulation control chamber, said modulation control valve assembly controlling an operating pressure within said modulation control chamber and providing a first pressure within said modulation control chamber when operated in the first mode to displace said modulation valve ring to the first position and providing a second pressure within said modulation control chamber greater than the first pressure when operated in the second mode to displace said modulation valve ring to the second position and reduce operating capacity of the compressor.

6. The compressor of claim 5, wherein said modulation valve ring is displaced axially away from said modulation lift ring when said modulation valve ring is displaced from the first position to the second position.

7. The compressor of claim 5, wherein said modulation valve ring includes a first passage extending from said axial biasing chamber to said modulation control valve assembly and a second passage extending from said modulation control chamber to said modulation control valve assembly.

8. The compressor of claim 5, wherein the first pressure is a suction pressure within the compressor and the second pressure is an operating pressure within said axial biasing chamber.

9. The compressor of claim 5, wherein said modulation control valve assembly is in fluid communication with said axial biasing chamber, said modulation control valve assembly providing fluid communication between said modulation control chamber and said axial biasing chamber when operated in the second mode.

10. The compressor of claim 9, wherein said modulation control valve assembly is in fluid communication with said suction-pressure region, said modulation control valve assembly providing fluid communication between said modulation control chamber and said suction-pressure region when operated in the first mode.

11. The compressor of claim 5, wherein said modulation valve ring defines an annular recess having said modulation lift ring disposed therein.

12. The compressor of claim 5, wherein said modulation lift ring abuts said first end plate when said modulation valve ring is in the second position.

13. The compressor of claim 1, further comprising a drive shaft engaged with said second scroll member and driving orbital displacement of said second scroll member relative to said first scroll member, said second end plate defines a second discharge port in communication with said second valve assembly.

14. The compressor of claim 13, wherein said second valve assembly isolates communication between said second intermediate-pressure pocket and said discharge-pressure pocket via said second port when in the closed position and provides communication between said second intermediate-pressure pocket and said discharge-pressure pocket via said second port when in the open position.

15. The compressor of claim 14, wherein a flow path is defined from said second intermediate-pressure pocket to said first discharge port via said second port and via said second discharge port when said second valve assembly is in the open position.

16. The compressor of claim 15, wherein said second scroll member includes a drive hub extending from said second end plate and engaged with said drive shaft, said second valve assembly being located within said drive hub and axially between said drive shaft and said second end plate.

17. The compressor of claim 16, wherein said first valve assembly includes:

a modulation valve ring located axially between a seal assembly and said first end plate and being in sealing engagement with an outer radial surface of an annular hub and said seal assembly to define an axial biasing chamber in fluid communication with a biasing passage in said first end plate, said modulation valve ring being axially displaceable between first and second positions, said modulation valve ring abutting said first end plate and closing said first port when in the first position and being displaced axially relative to said first end plate and opening said first port when in the second position;

a modulation lift ring located axially between said modulation valve ring and said first end plate and being in sealing engagement with said modulation valve ring to define a modulation control chamber; and a modulation control valve assembly operable in first and second modes and in fluid communication with said modulation control chamber, said modulation control valve assembly controlling an operating pressure within said modulation control chamber and providing a first pressure within said modulation control chamber when operated in the first mode to displace said modulation valve ring to the first position and providing a second pressure within said modulation control chamber greater than the first pressure when operated in the second mode to displace said modulation valve ring to the second position and reduce operating capacity of the compressor.

18. The compressor of claim 17, wherein said modulation valve ring is displaced axially away from said modulation lift ring when said modulation valve ring is displaced from the first position to the second position.

19. The compressor of claim 18, wherein said modulation valve ring includes a first passage extending from said axial biasing chamber to said modulation control valve assembly and a second passage extending from said modulation control chamber to said modulation control valve assembly.

20. The compressor of claim 19, wherein said modulation valve ring defines an annular recess having said modulation lift ring disposed therein.

21. The compressor of claim 1, wherein said shell assembly defines said suction-pressure region and said discharge-pressure region.

* * * * *